United States Patent [19]

Feldt

[11] Patent Number: 4,821,350

[45] Date of Patent: Apr. 18, 1989

[54] CHILD DELIVERY BED

[75] Inventor: Mats Feldt, Liatorp, Sweden

[73] Assignee: Landstingens Inkopscentral, Lic, Ekonomisk Forening, Solna, Sweden

[21] Appl. No.: 22,202

[22] Filed: Mar. 5, 1987

[30] Foreign Application Priority Data

Mar. 5, 1986 [SE] Sweden ..... 8601007

[51] Int. Cl.[4] ..... A61H 7/02

[52] U.S. Cl. ..... 5/60; 269/327; 5/66

[58] Field of Search ..... 5/60, 90, 66, 67, 68; 269/327

[56] References Cited

U.S. PATENT DOCUMENTS

| | | | |
|---|---|---|---|
| 470,251 | 3/1872 | Morrison | 269/327 |
| 987,189 | 3/1911 | Thorner | 269/327 |
| 1,607,168 | 11/1926 | Murphy . | |
| 1,762,944 | 6/1930 | Allison . | |
| 3,334,951 | 8/1967 | Douglass, Jr. et al. | 5/90 |
| 4,139,917 | 2/1979 | Fenwick | 5/60 |
| 4,221,371 | 9/1980 | Kupnal | 269/327 |
| 4,287,422 | 9/1981 | Kupnal et al. | 269/327 |
| 4,615,058 | 10/1986 | Feldt | 5/60 |
| 4,639,954 | 3/1987 | Speed | 5/69 |
| 4,650,171 | 3/1987 | Noworth | 269/327 |

FOREIGN PATENT DOCUMENTS

| | | | |
|---|---|---|---|
| 0058411 | 8/1982 | European Pat. Off. . | |
| 636085 | 3/1928 | France | 5/90 |

*Primary Examiner*—Alexander Grosz
*Assistant Examiner*—Eric K. Nicholson
*Attorney, Agent, or Firm*—Young & Thompson

[57] ABSTRACT

A child delivery bed includes a raisable backrest section which is located at one end of a center section, and further includes a leg support section that can be displaced axially beneath the center section. The center section has provided on the edge part thereof facing the leg support section a sunken recess which is open towards the leg support section, therewith to enable blood and other substances to run down to the underlying leg support section. The leg support section has formed thereon a longitudinally extending channel, the width extension of which is at least equal to the width of the open end of the sunken recess and which slopes down towards the outer end portion of the leg support section, at which end portion the bottom of the channel terminates at a drainage edge. Detachably arranged beneath the drainage edge is a collecting vessel for collecting blood and other substances running down from the drainage edge. The vessel thus accompanies the leg support section during its adjustment to different desired positions, in which positions blood running from the sunken recess will always be collected in the channel for drainage into the collecting vessel.

7 Claims, 3 Drawing Sheets

CHILD DELIVERY BED

The present invention relates to a child delivery bed.

Because the leg support section of the bed can be pushed in beneath the centre section thereof, and the backrest section of the bed can be raised, the patient is able to take a semi-sitting delivery position, with the legs of the patient drawn well up and resting on separate leg supports. Alternatively, the leg support section can be extended to a greater or a lesser extent, should the patient desire to take a more recumbent delivery position, with the legs of the patient more extended. The mattress located on the bed centre section has arranged in the rearwardly located edge wall thereof a recess or hollow which facilitates a delivery and which is intended to carry away, for instance, blood during said delivery. In the case of known delivery beds, the blood and other substances emanating from the patient run onto the leg support section, under certain conditions, and spreads to the sides and to the outer end of the leg support section in an uncontrollable manner. To avoid this, it is known to provide a transversely extending slot at some region of the leg support section, and to place a collecting vessel on the floor, beneath the slot. This arrangement, however, is only effective in certain positions of the leg support section.

The object of the present invention is to provide a child delivery bed with which blood and other substances emanating from a patient during the delivery of a baby can be collected effectively in all positions of the leg support section.

This object is achieved with a delivery bed having the characteristic features set forth in the characterizing clause of the following main claim. The blood and other substances that run down into the recess or hollow in the rear end wall of the mattress located on the bed centre section will run over the rear edge of the sunken recess located in the centre section, so as to be constantly deposited in the elongated channel provided on the upper side of the leg support section. The channel slopes steeply towards the region of the outer end of the leg support section, at which end a drainage edge is provided at the terminal end of the channel. The blood and other substances run over this edge and down into a collecting vessel which is located beneath the drainage edge and which is carried detachably on suspension means attached to the leg support section of the bed. The vessel will thus accompany the leg support section during its movement between the various positions to which it is adjusted, and will take a given position beneath the drainage edge.

These and other characteristic features of the invention, together with advantages afforded thereby, will now be described in more detail with reference to the accompanying drawings.

FIG. 1 is a schematic, broken perspective view of an exemplifying embodiment of a bed according to the invention, in which Figure the mattress has been omitted and the leg support section of the bed is shown in its fully inwardly displaced position and the backrest section is partially raised. The cover sheets on the centre part of the bed and on the leg support section are illustrated in longitudinal section at the centre of the bed.

Figure 1:
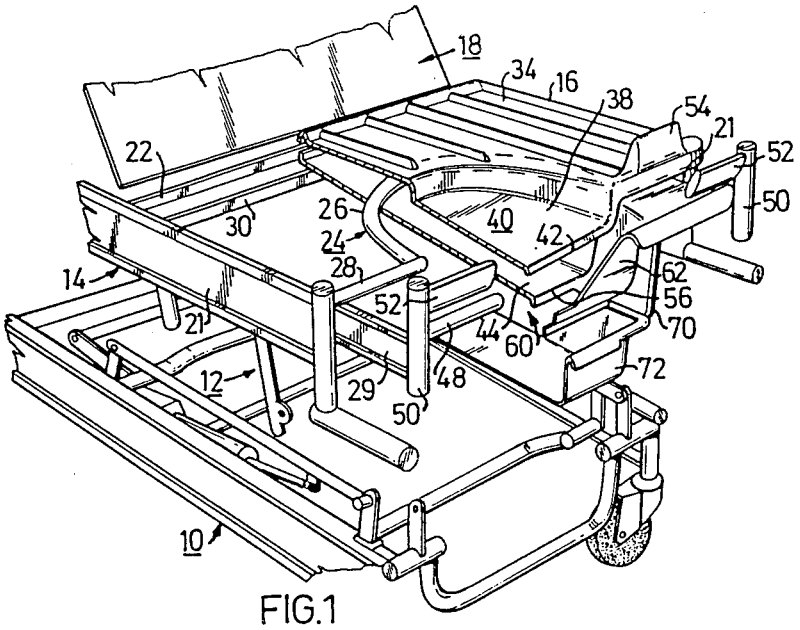
Figure 2:
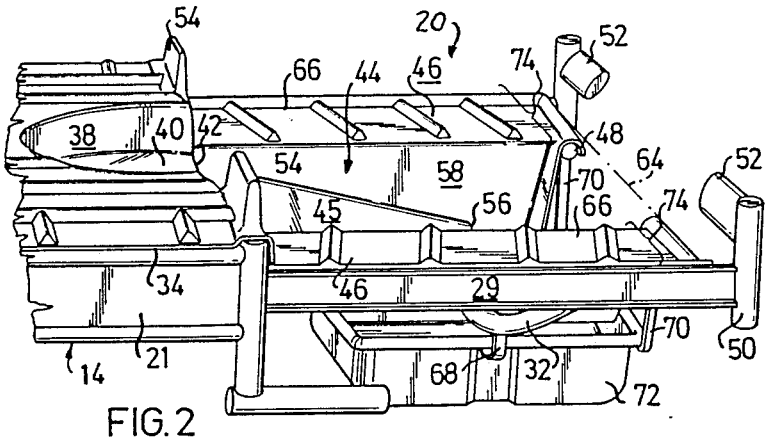
FIG. 2 is a perspective view taken obliquely from behind, the leg support section being shown in an extended position.

The bed comprises, in a known manner, a wheel-supported base part 10 which carries, through a known mechanism 12, an upper part 14 comprising a centre section 16, a backrest section 18 and a leg support section 20 which can be displaced inwardly to a position beneath the centre section 16. The upper part of the bed can be raised and lowered, and also inclined. Rearward inclination of the upper part of the bed in particular may be exaggerated at times, to provide a shock position, the so-called trendelenburg position.

In the illustrated bed position of FIG. 1, the leg support section is displaced beneath the centre section to its inner terminal position, the outer more extended terminal position of said leg support section being located in the proximity of the rear edge of the centre section.

The centre section comprises two steel side members 21 which are connected together by a plurality of steel cross struts 22, to form a steel framework. The forwardly located cross strut 24 is curved arcuately at the centre thereof, and presents two side arms 28, each of which is connected to a respective side member 21.

The leg support section also comprises two side members, referenced 29, which are connected together through a plurality of cross struts 30, 32 so as to form a steel framework. The side members 29 are guided for axial movement in known guide means (not shown) provided on the inwardly facing surfaces of the side members 21 of the centre section. These guide means may comprise a conventional pulley arrangement. Preferably, means are provided for locking the leg support section in the desired extended position to which it is adjusted.

Figure 6:
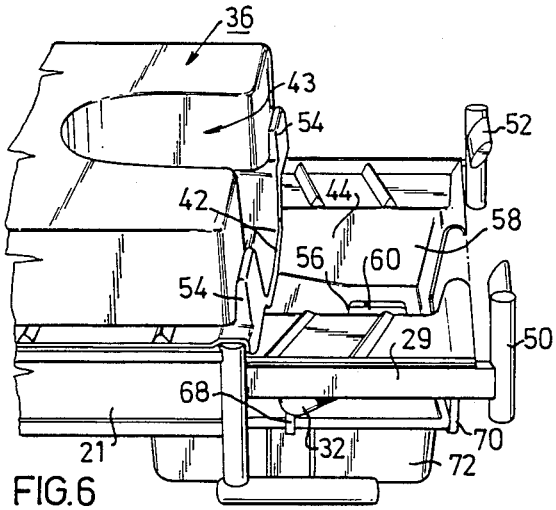
FIG. 6 is a perspective side view which shows a mattress positioned on the centre part of the bed, the mattress having a recess or hollow provided in one rear end wall thereof.

Placed on the centre section is a cover sheet 34 which forms a support for the mattress 36 shown in FIG. 6. Although not shown, a mattress is also placed on the backrest section 18. A mattress can also be placed on the leg support section when said section is fully extended, thereby enabling the bed to be used as a conventional bed, with all three mattresses lying essentially in the same plane when the backrest section is lowered to its horizontal position.

The cover sheet of the centre section is placed on the side members 21 and on the cross struts 22,34, and has provided therein a sunken recess 38, the bottom 40 of which slopes towards the rear edge 42 of said recess. The sunken recess 38 is essentially of the same size as, or somewhat larger than, a recess or hollow 43 provided in the rear end wall of the mattress, so that blood and other substances that run down in the mattress recess will collect in the sunken recess 38 and run down towards the rear edge 42 of the sunken recess, and from there into a channel 44 provided on the upper side of the leg support section, said upper side comprising a further cover sheet 46.

The cover sheet 46 that covers the leg support section is placed on the side members 29 and cross strut 30 of said section, and also rests on a pair of short side arms 48 located on the outer end of the leg support section. These arms are secured to vertical tubes 50, which are in turn secured to the outer ends of the respective side members 29 of the leg support section. Each of the tubes 50 also carries a respective foot support 52.

Arranged on the forward edge of the centre-section cover-member are supports 54 for holding the mattress 36 steady on said centre section 16.

The bottom 40 of the sunken recess slopes towards the rear edge 42, which is lowered slightly into the channel 44 so as to ensure that blood and other substances will run into said channel.

Figure 5:
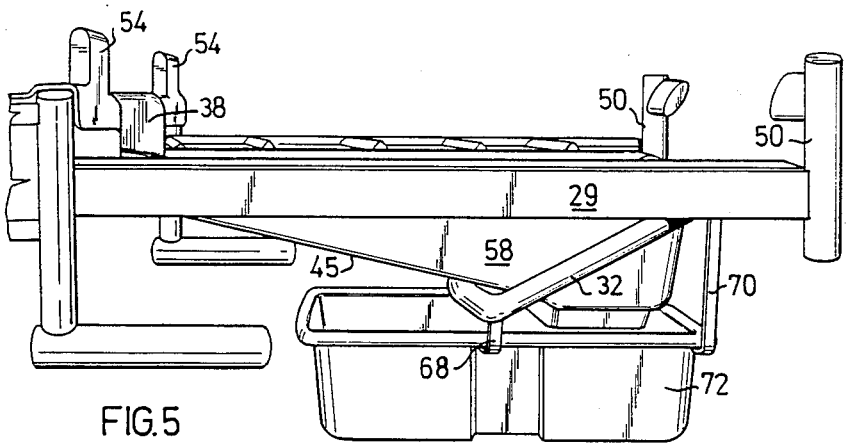
FIG. 5 is a side view which illustrates the leg support section in an extended position.

As will be seen from FIG. 5, the channel 44 slopes at a relatively steep angle, this angle lying in the range of 10° to 20° to the plane of the side members of the leg support section, in the illustrated embodiment 15°, such that the channel will slope downwardly relative to the horizontal even when the centre section, together with the leg support section, is steeply inclined rearwardly in the aforementioned shock position.

The channel bottom 45 terminates at its outer end with a drainage edge or lip 56 which lies between the side walls 58 of the channel. In the illustrated embodiment, the drainage edge comprises one defining edge of a drainage aperture 60 formed in the bottom of the channel.

The drainage aperture 60 lies adjacent an end wall 62 at one end of the leg support section, which wall may be a full wall structure, in the manner shown in chain lines at 64, or may be provided with a V-shaped recess 66, as shown in full lines.

Figure 3:
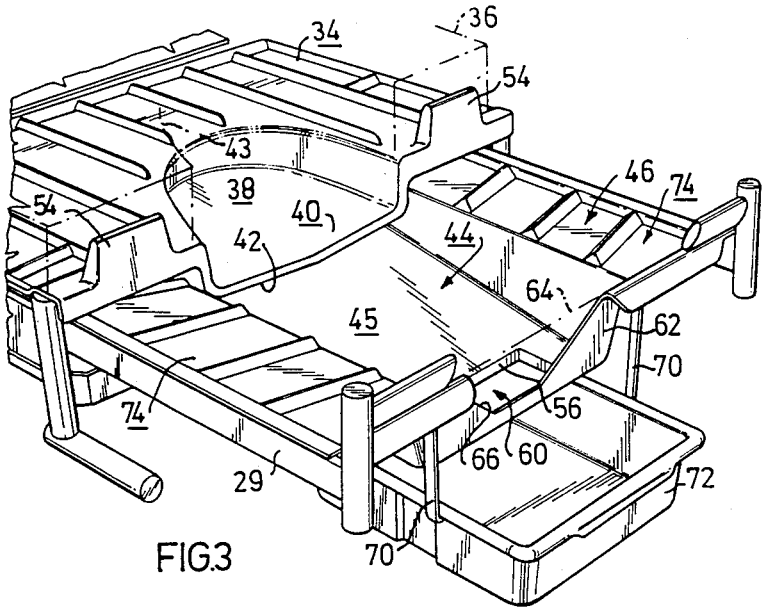
FIG. 3 is a perspective view taken obliquely from the front, with the leg support section shown in an extended position and the collecting vessel also in an extended position.
Figure 4:
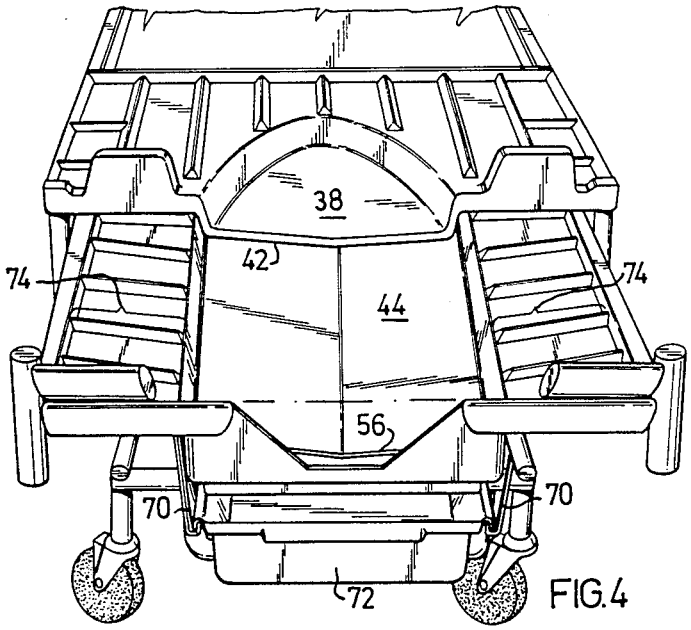
FIG. 4 is a perspective view which illustrates the leg support section in an extended position.

The leg support section has fastened thereto a plurality of carrier arms 68,70, the lower ends of which are bent inwards, to support the collecting vessel 72 through engagement with a flanged edge provided on said vessel of the illustrated embodiment. The vessel can be displaced inwardly to an inward terminal position, as shown in FIG. 1, or may be withdrawn to a greater or lesser extent in accordance with FIG. 3. It shall, however, be located beneath the drainage edge 56 or the drainage aperture 60 under all circumstances.

The collecting vessel thus accompanies the leg support section when adjusting said section to the position desired, and will therefore always be located in a position in which the safe collection of all substances that flow over the channel drainage edge 56 is ensured.

The channel takes-up approximately half the width of the cover sheet on the leg support section, thereby leaving side portions 74 which slope down towards the channel 44. These side portions may be used as ledges on which vessels, containers, instruments etc. can be placed.

The two cover sheets may be made of stainless steel sheet or of a plastics material.

I claim:

1. A child delivery bed comprising a raisable backrest section located at one end of a centre section, and a leg support section which is located at the other end of the centre section and which can be displaced axially to different positions beneath said centre section, characterized in that the upper side of the centre section has provided thereon a sunken recess which is open in the vicinity of a rear edge of the centre section, so as to facilitate drainage of, e.g., blood at one edge of the sunken recess; in that the upper side of the leg support section has provided thereon a longitudinally extending channel which lies below the rear edge of the sunken recess and has a length such as to lie at a lower level than said edge of the sunken recess in all positions of the leg support section; in that the channel slopes down towards and extends to adjacent an outer end part of the leg support section, and the bottom of said channel terminates at a drainage edge; and in that the leg support section is provided with means for detachably supporting a collecting vessel in a position beneath the drainage edge, the channel being sunk between two longitudinally extending side parts of the upper side of the leg support section and the recess nesting within the channel between said side parts.

2. A bed according to claim 1, characterized in that the rear edge of the sunken recess is located within the channel, between side walls thereof.

3. A bed according to claim 1, characterized in that the drainage edge comprises an edge of a drainage aperture formed in the bottom of the channel.

4. A bed according to claim 3, characterized in that an end wall is arranged at the outer end of the leg support section on the side of the drainage aperture opposite the drainage edge.

5. A bed according to claim 4, characterized in that said end wall has provided therein a recess which extends from the upper edge of said wall.

6. A bed according to claim 1, characterized in that the side parts slope laterally down towards the channel.

7. A bed according to claim 1, characterized in that located on the centre section is a cover sheet which has a recess provided therein; and in that the channel and the drainage edge are embodied in a further cover sheet located on the leg support section.

* * * * *